United States Patent [19]

Hanson

[11] Patent Number: 4,466,494

[45] Date of Patent: Aug. 21, 1984

[54] IMPLEMENT WITH GRIPPING ARM ASSEMBLY FOR A BACKHOE

[75] Inventor: Charles B. Hanson, Burlington, Iowa

[73] Assignee: J. I. Case Company, Racine, Wis.

[21] Appl. No.: 411,544

[22] Filed: Aug. 25, 1982

[51] Int. Cl.[3] ..... E21C 37/00

[52] U.S. Cl. ..... 173/46; 37/2 R; 37/DIG. 3; 414/704; 414/740; 241/275; 241/285 R

[58] Field of Search ..... 414/680, 739, 740, 704, 414/724; 37/2 R, DIG. 3, 12; 172/464, 474; 173/46; 241/273, 285; 299/37, 38

[56] References Cited

U.S. PATENT DOCUMENTS

| | | | |
|---|---|---|---|
| 2,042,196 | 5/1936 | Senz | 37/2 R |
| 2,912,774 | 11/1959 | McCrary | 37/2 R X |
| 4,087,010 | 5/1978 | Stormon | 414/722 |
| 4,375,345 | 3/1983 | Hanson | 414/729 X |

FOREIGN PATENT DOCUMENTS

| | | | |
|---|---|---|---|
| 846671 | 7/1981 | U.S.S.R. | 37/DIG. 3 |

*Primary Examiner*—Robert J. Spar
*Assistant Examiner*—Donald W. Underwood
*Attorney, Agent, or Firm*—Dressler, Goldsmith, Shore, Sutker & Milnamow, Ltd.

[57] ABSTRACT

An improved arrangement for gripping objects is disclosed which is particularly suited for embodiment in association with an excavator having a hydraulic hammer. The arrangement includes a gripping arm assembly operatively associated with the hydraulic hammer, including a gripping arm selectively movable with respect to the hammer. The arrangement can further include a detachably mountable clamping arm assembly adapted to be attached to the dipper arm of the excavator. The gripping arm and clamping arm assemblies are adapted to cooperate with each other with a claw-like working action to facilitate gripping of objects, such as material broken with the hydraulic hammer.

3 Claims, 8 Drawing Figures

IMPLEMENT WITH GRIPPING ARM ASSEMBLY FOR A BACKHOE

FIELD OF INVENTION

This invention relates generally to material handling equipment, and more particularly to an improved arrangement for gripping objects adapted to be mounted on a backhoe or similar excavator.

BACKGROUND OF INVENTION

Backhoes and similar excavators are used for a variety of material handling and excavation functions. Excavators of this type generally include an articulated arm mounted on a ground supported frame, and a hammer, bucket assembly, or like implement pivotally mounted to the distal end of the arm. Hydraulic fluid actuators provide selective movement of the arm and hammer or bucket assembly for performing a wide variety of breaking, digging and scooping operations. Such equipment is quite versatile and can be used for a great variety of construction endeavors and like material handling operations.

The working action of excavators of this nature typically involves breaking, scooping or curling movement. Therefore, without the use of specialized attachments, these excavators are not readily used for gripping or grasping objects. Efficient gripping and moving of objects requires a gripping or claw-like working action. Due to the added versatility which a working action of this nature provides, hydraulically actuated clamping arms are frequently installed on the articulated arms of the backhoe or excavator.

Clamping arm assemblies of this nature typically include a pivotally mounted clamping arm which is movable into and out of cooperation with the hammer tool, the bucket, or other implement of the machine to readily facilitate gripping objects with a claw-like working action. For added versatility, some clamping assemblies include removable mounting plates which allow the ready transfer of the assembly from one piece of machinery to another. Commonly assigned U.S. Pat. No. 4,375,345, filed July 23, 1981, illustrates one such removable clamping arm assembly which has proven particularly convenient to mount and use.

While the above-described gripping assemblies enhance the versatility of a backhoe or like excavator, their use in cooperation with a hydraulic hammer or like implement can be problematic. Because such hammers typically include a pointed hammer bit or tool, grasping objects between the clamping arm and hammer bit can be difficult, if not impossible, particularly when the objects to be moved are irregularly shaped. Naturally, the hammer bit must be configured for efficient performance of its primary breaking function, and thus providing a bit which is better suited for claw-like cooperation with the clamping arm is not practical.

Thus, it would be beneficial to provide a movable gripping arm associated with the hydraulic hammer or like implement of an excavator for use in cooperation with a clamping arm. Such a gripping arm assembly facilitates the gripping and moving of irregularly shaped objects as well as improving the handling of regular shaped objects.

SUMMARY OF THE INVENTION

The subject invention provides an improved object-gripping arrangement for use with a backhoe, or similar excavator. In the preferred embodiment, the invention includes a novel implement-mounted movable gripping arm, in combination with a detachable clamping arm assembly. The arrangement greatly facilitates efficient handling of both regularly and irregularly shaped objects, and is particularly suited for use in association with a hydraulic hammer. Such an arrangement permits use of the hammer for breaking, with the gripping arm and clamping arm then being readily used for grasping broken pieces of material.

The subject invention includes an arrangement for gripping associated with a hammer or like implement supported on the dipper arm of the excavator, and which is selectively movable with respect to the implement. The gripping means comprises a gripping arm and gripping arm actuator. The gripping arm actuator allows selective positioning of the gripping arm between a first, retracted non-use position, and a second, extended use position. In the illustrated embodiment, the implement comprises a hydraulically-operated hammer having an implement housing defining a cavity in which the gripping arm is substantially disposed when positioned in the non-use position. The gripping arm fluid actuator is operatively connected between the implement housing and the gripping arm, allowing selective movement of the gripping arm within the implement housing cavity. The gripping arm preferably includes a gripping tip of bifurcated construction to facilitate observation of the operation of the hammer tool when the gripping arm is in the non-use position.

The preferred embodiment of the subject invention further includes a detachably mounted clamping arm arrangement adapted to cooperate with the gripping arm. The clamping arm arrangement includes an arm link which is adapted to be mounted in fixed abutting relation with the lower surface of the dipper arm of the backhoe or excavator. A clamping arm is pivotally connected to the arm link and extends therefrom for pivotal movement. A clamping arm fluid actuator operatively extends between the arm link and the clamping arm. A first end of the fluid actuator is pivotally connected to the arm link spaced from the pivotal connection of the clamping arm to the arm link. A second end of the fluid actuator is pivotally connected to the clamping arm, whereby selective actuation of the actuator provides selective pivoting movement of the clamping arm toward and away from the gripping arm of the hammer tool. This allows a claw-like working action to be provided for grasping and moving objects.

The clamping arm assembly of the subject invention includes an arrangement for detachably mounting the arm link in fixed abutting relation to the lower surface of the dipper arm. The mounting arrangement includes a pair of mounting plates disposed on opposite sides of the dipper arm. Lower portions of the mounting plates support the arm link of the assembly. Each of the mounting plates is supported by and engageable with first and second spaced pins provided on the dipper arm of the backhoe. In the preferred embodiment, the first pin comprises the implement pivot pin which pivotally supports the implement on the dipper arm. Each of the mounting plates includes cut-out portions which are adapted to engage the ends of the respective pins, and accommodate disengagement therefrom.

The mounting arrangement of the clamping arm assembly further includes a lock bolt threaded to the arm link of the assembly. The lock bolt is adapted to be moved between a locked position and an unlocked position. In the locked position, the lock bolt is moved into engagement with the lower side of the dipper arm, so that each of the mounting plates is maintained in engagement with the spaced pins on the dipper arm to maintain the arm link in a fixed, abutting relation to the lower surface of the dipper arm.

The clamping arm assembly can be removed from the backhoe by moving the lock bolt to the unlocked position. This allows the cut-out portions of the mounting plates to be disengaged from the pins on the dipper arm to permit detachment of the entire clamping arm assembly from the dipper arm.

Thus, a novel gripping arrangement for a backhoe is provided which facilitates efficient gripping and moving of both regular and irregular shaped objects while not interferring with the use of the implement for its desired breaking or digging function.

Numerous other advantages and features of the present invention will become readily apparent from the following detailed description of the invention and embodiment thereof, from the claims, and from the accompanying drawings in which like numerals are employed to designate like parts throughout the same.

DESCRIPTION OF THE PREFERRED EMBODIMENT

Figure 1:
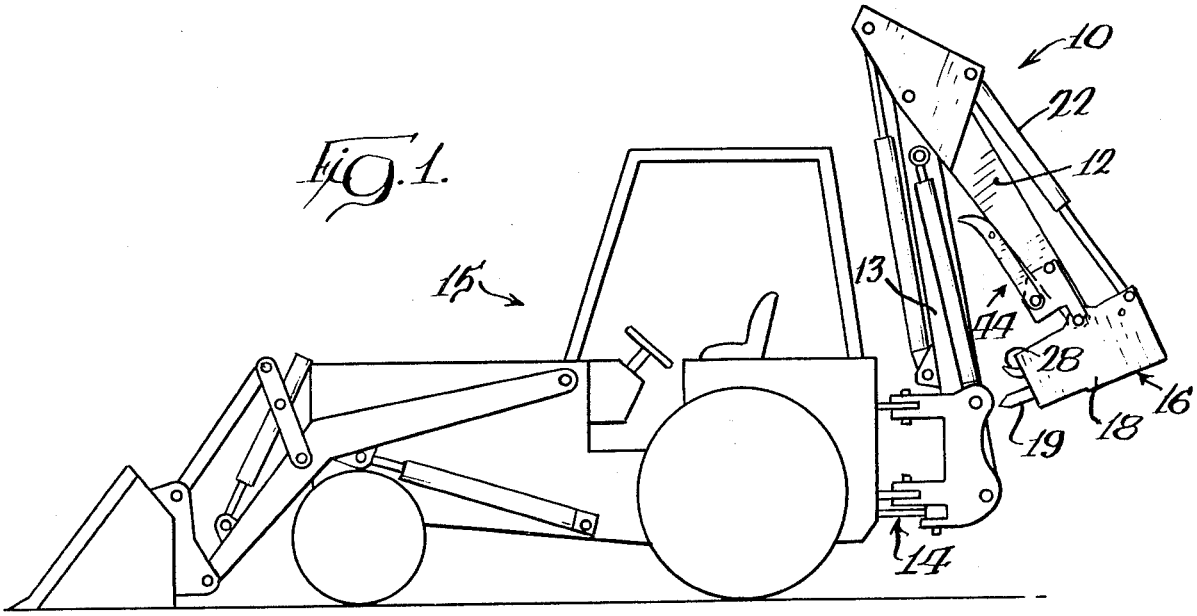
FIG. 1 is a side elevational view of a tractor having a dipper arm and hammer implement assembly embodying the subject invention mounted thereon.

While this invention is susceptible of embodiment in many different forms, there is shown in the drawings and will herein be described in detail a presently preferred embodiment, with the understanding that the present disclosure is to be considered as an exemplification of the principals of the invention and is not intended to limit the invention to the embodiment illustrated.

Upon inspection of FIG. 1, it will be seen that a backhoe assembly 10 is therein illustrated. Although a backhoe assembly such as 10 frequently includes a bucket for effecting work operations, assembly 10 is illustrated as including a hydraulic hammer, as will be described, since the present invention particularly facilitates material handling when embodied in association with a hammer. While the subject invention as described herein is shown in conjunction with a backhoe, it will be understood by those skilled in the art that the gripping arrangement of the subject invention is equally suitable for use with similar excavating equipment.

The backhoe assembly 10 includes a dipper arm 12 and a boom 13 which are supported for articulated movement by a ground supported frame 14 mounted on tractor 15. The backhoe assembly 10 includes an implement means 16, illustrated as a hydraulic hammer, having a housing 18 and an implement tool 19. The implement housing 18 is pivotally connected to the dipper arm 12 by an implement pivot pin 20 for pivotal movement about a horizontal axis. An implement fluid actuator 22 provides selective pivoted movement of the implement housing 18 through an implement actuator pivot pin 24.

Figure 4:
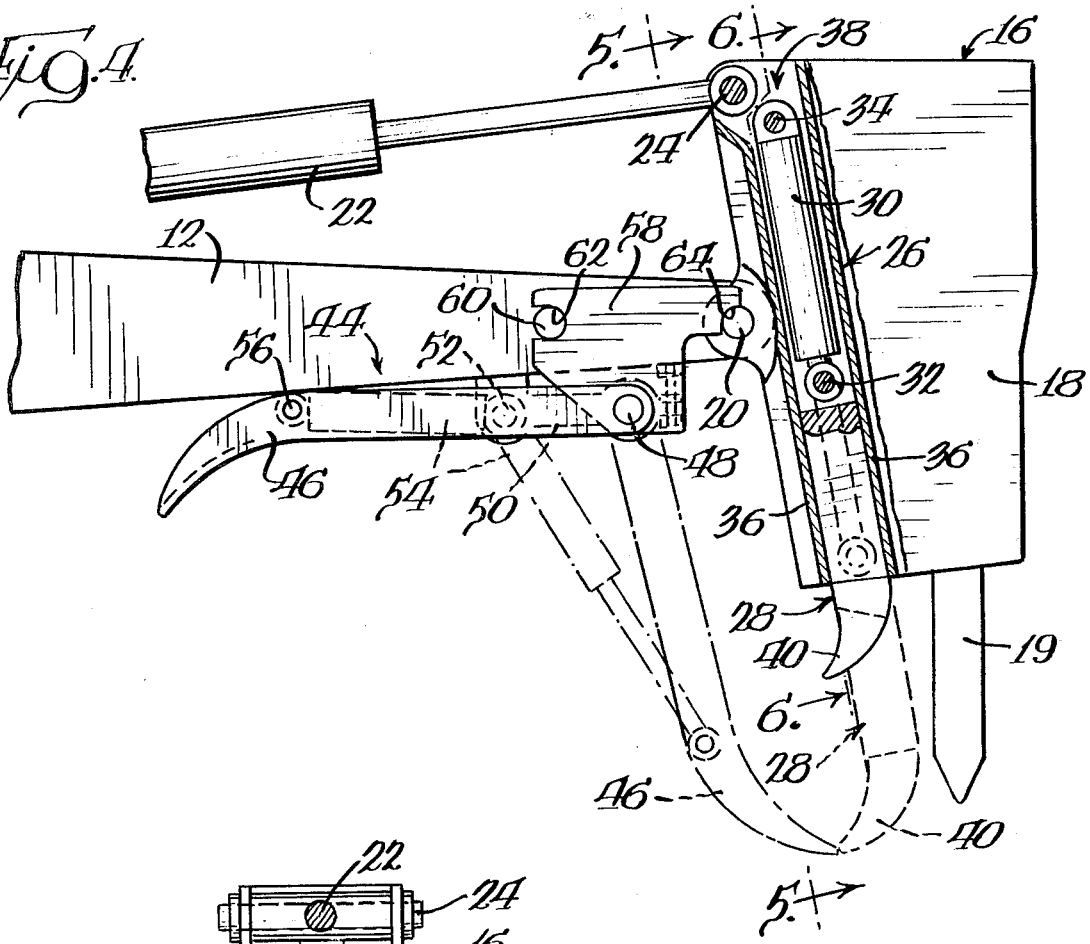
FIG. 4 is an enlarged side elevational view in partial cutaway of the gripping and clamping arm assemblies of the present gripping arrangement.

In the illustrated embodiment of the present invention, a gripping arm assembly 26 is disposed within the implement housing 18. As best shown in FIG. 4, the gripping arm assembly 26 includes a gripping arm 28 and a gripping arm fluid actuator 30. The gripping arm 28 is operatively connected to one end of the gripping arm fluid actuator 30 by a connecting pin 32. The other end of the gripping arm fluid actuator 30 is connected to the implement housing 18 by an actuator support pin 34. These connections are best shown in FIGS. 4 and 6.

The implement housing 18 includes walls 36 defining a cavity 38 within the implement housing 18. The gripping arm assembly 26 is mounted within the cavity 38 and connected to the implement housing 18 by the actuator support pin 34. This positioning allows for the linear movement of the gripping arm 28. Through selective actuation of the gripping arm fluid actuator 30 the gripping arm 28 may be positioned between extended use and retracted non-use positions. While in the non-use position the gripping arm is substantially disposed within the cavity 38 of the implement housing 18.

Figure 5:
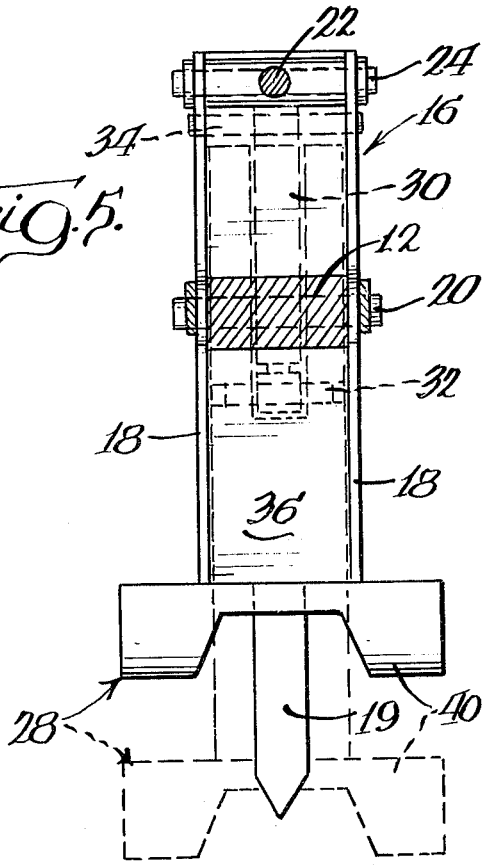
FIG. 5 is a view taken generally along lines 5—5 of FIG. 4.
Figure 6:
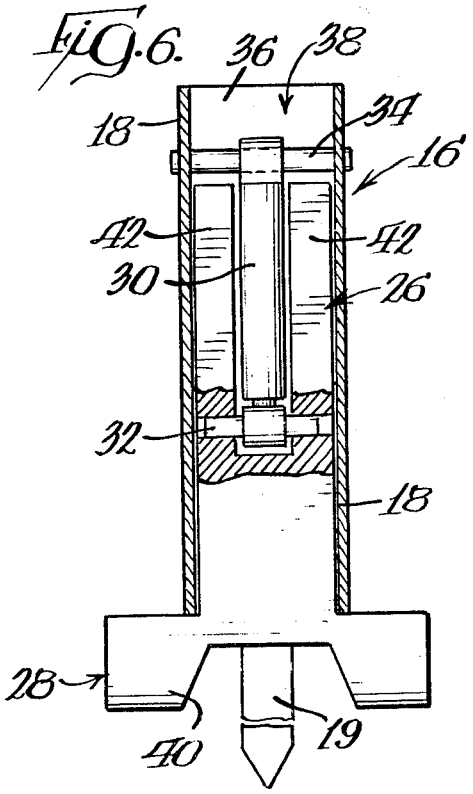
FIG. 6 is a view taken generally along lines 6—6 of FIG. 4.

The gripping arm 28 also has a gripping tip portion 40 preferably of bifurcated construction, and an opposite end of forked construction including two upper gripping arm portions 42, as shown in FIGS. 5 and 6. The bifurcated construction of gripping tip portion 40 allows the gripping arm to grasp a wide variety of differently shaped objects and lends to its gripping versatility, while allowing increased visibility of the implement tool 19 when the gripping arm 28 is in the non-use position. The forked construction of the opposite end of the gripping arm facilitates the positioning of the gripping arm 28 in the use or non-use positions. The gripping arm fluid actuator 30 is preferably centrally disposed between the two gripping arm fingers 42 when the gripping arm is disposed in the non-use position and substantially within the cavity 38. The gripping arm 28 is connected to the gripping arm fluid actuator 30 with connecting pin 32 at the end of the gripping arm fingers 42 closest to the gripping tip portion 40. Actuation of the gripping arm fluid actuator 30 causes the gripping arm 28 to extend from the cavity 38 of the implement housing 18 to the use position. The preferred illustrated configuration of actuator 30 and gripping arm 28 as illustrated permits the gripping arm to abut and bear against walls 36 when the gripping arm is used for grasping objects in its use position.

Figure 7:
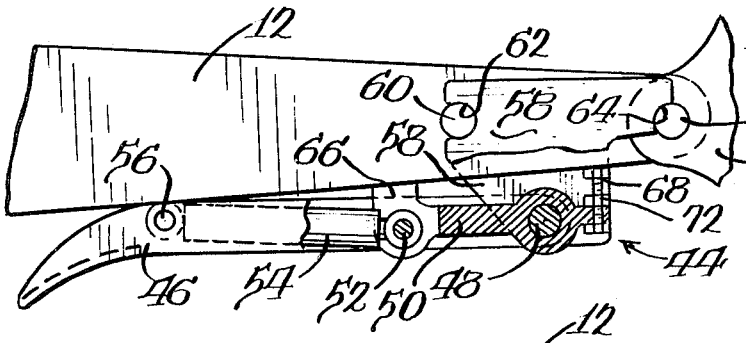
FIG. 7 is a side elevational view in partial cross-section and cutaway illustrating the clamping arm assembly of the present gripping arrangement in its locked position.

In accordance with a further feature of the present invention, a clamping arm assembly 44 is provided on the dipper arm 12 generally adjacent to its distal end portion. As shown in FIGS. 4 and 7, the clamping arm assembly 44 includes a clamping arm 46 pivotally supported by arm pivot pin 48. It will be understood by those familiar with the art that clamping arm 46 may comprise a single elongate arm portion extending from only one side of the arm pivot pin 48, or a double arm portion extending from opposite sides of the arm pivot pin 48.

The clamping arm assembly 44 further includes arm link 50 which is adapted to be detachably mounted in fixed abutting relation to the lower surface of the dipper arm 12. In the preferred embodiment, arm link 50 further includes a pivot pin 52 for pivotally connecting one end of a clamping arm fluid actuator 54 to arm link 50. The other end of the clamping arm fluid actuator 54 is pivotally connected to clamping arm 46 by arm actuator pivot pin 56. Therefore, the selective actuation of clamping arm fluid actuator 54 provides selective pivoting movement of the clamping arm 46 with respect to the arm link 50. This allows the clamping arm 46 to be positioned between a non-use position generally adjacent the lower end of the dipper arm 12 (shown in solid line in FIG. 4), and a use position extending away from the dipper arm (shown in phantom line in FIG. 4).

In keeping with one of the objects of the invention, clamping arm assembly 44 preferably further includes a pair of mounting plates 58 (see FIG. 7). The mounting plates 58 are maintained in spaced relation by connection to opposite ends of the arm pivot pin 48. The maintenance of this spaced relation allows the mounting plates 58 to be disposed on respective sides of the dipper arm 12, allowing detachable mounting thereto.

Figure 8:
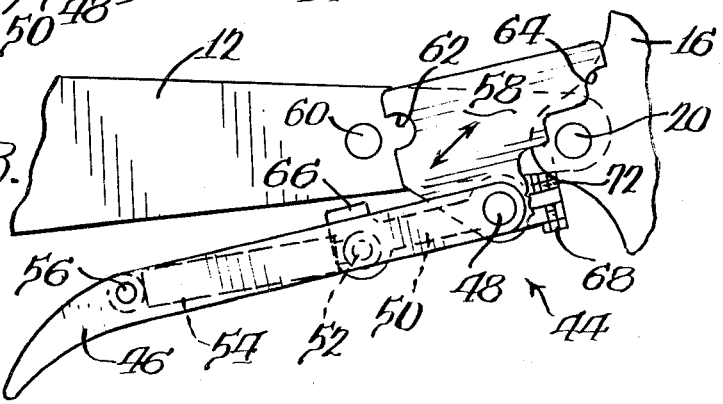
FIG. 8 is a view similar to FIG. 7 illustrating detachment of the clamping arm assembly from the dipper arm of the backhoe.

To facilitate the detachable mounting of the clamping arm assembly 44, each mounting plate defines cut-out portions 62 and 64. It will be observed that cut-out portion 62 of each plate 58 is generally semi-circular, while cut-out portion 64 of each plate subscribes an arc which is somewhat more than 90 degrees. As shown in FIGS. 4, 7, and 8, the cut-out portions 62 and 64 are adapted to respectively engage end portions of an arm link support pin 60 and the implement pivot pin 20 which extend beyond the opposite sides of the dipper arm 12. Thus, support of each of the mounting plates 58 is provided by its engagement with respective end portions of the arm link support and bucket pivot pins 60 and 20.

The means for detachably mounting the clamping arm assembly 44 to the dipper arm 12 further include an abutment portion 66 of arm link 50 (see FIGS. 7 and 8). As best illustrated in FIG. 7, the abutment portion 66 is adapted to abut and seat against the lower surface of the dipper arm 12. Detachable mounting of the clamping arm assembly 44 is further provided by inclusion of a lock bolt 68 which is threaded to a lock portion of the arm link 50. A lock nut 72 is provided on lock bolt 68 and is engageable with the lock portion of the arm link whereby lock bolt 68 may be maintained in fixed relation with respect to arm link 50.

The clamping arm assembly 44 is unitary in nature, including clamping arm 46, arm link 50, clamping arm fluid actuator 54, and mounting plates 58. To allow attachment of the clamping arm assembly 44 to the dipper arm 12 of the backhoe, lock bolt 68 is unscrewed through the lock portion of arm link 50 to the position shown in FIG. 8. Thus, clearance is provided between arm link 50 and the lower side of the dipper arm 12 so the entire clamping arm assembly 44 may be readily mounted on or removed from the dipper arm 12.

Attachment of the clamping arm assembly 44 is accomplished by positioning mounting plates 58 such that the arm link support pin 60 fits within cut-out portion 62 of each plate. The mounting plates 58 are then shifted downwardly by pivoting them about arm link support pin 60 until cut-out portions 64 seat against implement pivot pin 20. Mounting plates 58 are now engaged and supported by the ends of arm link support pin 60 and implement pivot pin 20, while the configuration of cut-out portions 62 and 64 prevents further downward movement of the mounting plates 58 with respect to dipper arm 12.

After engagement of mounting plates 58 with pins 20 and 60 as described, the clamping arm assembly 44 can be locked to the dipper arm 12 by rotating lock bolt 68 until it seats against the lower surface of the dipper arm 12, thereby firmly positioning arm link 50 in abutting relation against the lower surface of the dipper arm 12. To prevent loosening of the lock bolt 68, lock nut 72 provided on the lock bolt 68 is tightened against the lock portion of arm link 50. This fixed and locked configuration of the clamping arm assembly is clearly illustrated in FIG. 7. This procedure can be reversed allowing removal of the clamping arm assembly 44 from the dipper arm 12 of the backhoe.

Figure 2:
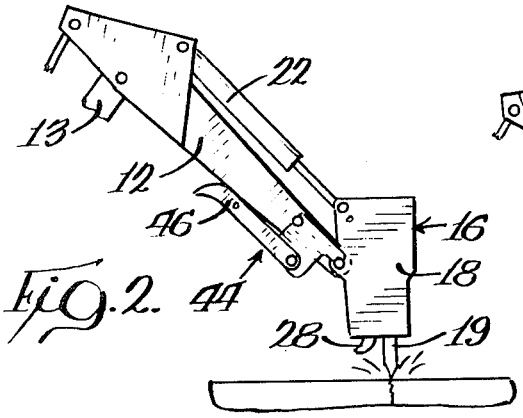
FIG. 2 is a partial side elevational view of the implement assembly illustrated in FIG. 1 in use, with the gripping arrangement of the subject invention in a non-use position.
Figure 3:
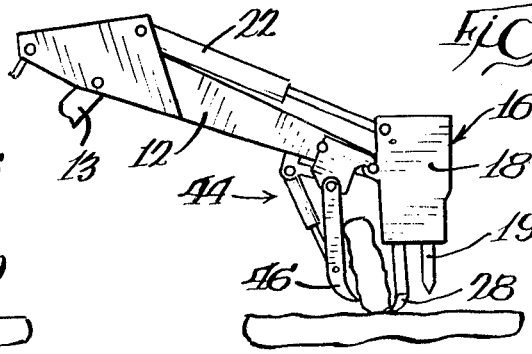
FIG. 3 is a view similar to FIG. 2 illustrating the present gripping arrangement in use.

FIGS. 2 and 3 illustrate the operation of the subject invention. FIG. 2 illustrates the clamping arm 46 and the gripping arm 28 in their respective non-use positions (as illustrated in solid line in FIG. 4). This allows the hammer implement 16 to be operated in its normal function. Notably, the preferred bifurcated construction of the gripping tip portion 40, as illustrated in FIGS. 5 and 6, facilitate a relatively unobstructed view of the implement tool 19, which facilitates efficient operation of the hammer.

FIG. 3 illustrates the gripping arm 28 and the clamping arm 46 in their respective use positions (further illustrated in phantom line in FIGS. 4 and 5). In this configuration, gripping arm 28 has been extended from within cavity 38 defined by implement housing 18 so that the clamping arm 46 may be operated in conjunction with gripping arm 28 and its bifurcated gripping tip portion 40 for grasping objects. During this operation, the gripping arm 28 is maintained in a fixed extended relation with respect to implement housing 18 by the gripping arm fluid actuator 30. The clamping arm 46 is selectively pivoted about arm pivot pin 48 by clamping arm fluid actuator 54, and gripping arm 28 may be selectively positioned by actuation of implement actuator 20. This allows clamping arm 46 and gripping arm 28 to be moved toward and away from each other with a claw-like working action to facilitate grasping both regular and irregular shaped objects. As will be appreciated, by this action the operator of the apparatus is able to effect breaking operations with the hydraulic hammer with greatly enhanced efficiency. After material to be handled is broken by hammer tool 19, gripping arm 28 and clamping arm 46 can be readily manipulated to easily move the broken material.

Thus, the subject invention provides a gripping arrangement comprising gripping arm and clamping arm assemblies for use with a backhoe or similar excavator for further increasing the versatility of the excavator.

From the foregoing, it will be appreciated that numerous variations and modifications may be affected without departing from the true spirit and scope of the novel concept of the subject invention. It will be understood that no limitation with respect to the specific apparatus illustrated herein is intended or should be inferred. It is, however, intended to cover by the appended claims all such modifications as fall within the scope of the claims.

What is claimed is:

1. An improved arrangement for gripping objects adapted for use with an excavator having a dipper arm, including a selectively movable clamping arm mounted on said dipper arm, comprising:

hydraulic hammer means adapted for pivotal support on the distal end of said dipper arm, said hammer means including a housing; and gripping arm means associated with said hammer means, including a gripping arm and gripping arm actuator means, said gripping arm being selectively movable with respect to said housing between retracted, non-use and extended, use positions by selective actuation of said actuator means, whereby said gripping arm is adapted to cooperate with said clamping arm in the extended position of said gripping arm for gripping objects.

2. The improved gripping arrangement of claim 1, wherein said gripping arm includes a gripping tip portion of bifurcated construction to facilitate observation of the operation of said implement means.

3. The improved gripping arrangement of claim 1, wherein, said gripping arm actuator means comprises a hydraulic fluid actuator.

* * * * *